US009096066B2

(12) United States Patent
Kamiyama

(10) Patent No.: US 9,096,066 B2
(45) Date of Patent: Aug. 4, 2015

(54) LIQUID EJECTION DEVICE

(71) Applicant: SEIKO EPSON CORPORATION, Tokyo (JP)

(72) Inventor: Nobuaki Kamiyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/472,983

(22) Filed: Aug. 29, 2014

(65) Prior Publication Data

US 2014/0368575 A1 Dec. 18, 2014

Related U.S. Application Data

(63) Continuation of application No. 13/875,752, filed on May 2, 2013, now Pat. No. 8,820,887, which is a continuation of application No. 13/046,963, filed on Mar. 14, 2011, now Pat. No. 8,454,120.

(30) Foreign Application Priority Data

Mar. 16, 2010 (JP) ..... 2010-058823
Jan. 14, 2011 (JP) ..... 2011-005582

(51) Int. Cl.
*B41J 2/15* (2006.01)
*B41J 2/165* (2006.01)

(52) U.S. Cl.
CPC ..... *B41J 2/16552* (2013.01); *B41J 2/16505* (2013.01); *B41J 2002/16555* (2013.01)

(58) Field of Classification Search
CPC ..... B41J 2/16552; B41J 2/16517; B41J 2/16523; B41J 29/17; B41J 2/18
See application file for complete search history.

(56) References Cited

U.S. PATENT DOCUMENTS

| | | | | |
|---|---|---|---|---|
| 7,775,621 | B2 | 8/2010 | Chun | |
| 7,871,147 | B2 | 1/2011 | Suzuki | |
| 8,454,120 | B2 * | 6/2013 | Kamiyama | 347/29 |

FOREIGN PATENT DOCUMENTS

| | | | |
|---|---|---|---|
| JP | 2002-019132 | A | 1/2002 |
| JP | 2006-249933 | A | 9/2006 |
| JP | 2006-347000 | A | 12/2006 |
| JP | 2007-185795 | A | 7/2007 |
| JP | 2010-120266 | A | 6/2010 |

* cited by examiner

*Primary Examiner* — Lamson Nguyen
(74) *Attorney, Agent, or Firm* — Global IP Counselors, LLP

(57) ABSTRACT

A liquid ejection device includes a liquid ejection head, a cleaning member, and a waste liquid tank. The liquid ejection head has a nozzle face on which a nozzle is formed. The cleaning member has a concave space therein and is configured to be attached to the nozzle face such that the concave space is arranged between the cleaning member and the nozzle face. The waste liquid tank is configured to collect cleaning liquid discharged from the cleaning member. The cleaning member further includes a first channel configured to supply the cleaning liquid toward the nozzle face and a second channel configured to discharge the cleaning liquid from the concave space.

10 Claims, 5 Drawing Sheets

LIQUID EJECTION DEVICE

CROSS-REFERENCE TO RELATED APPLICATIONS

This is a continuation application of U.S. application Ser. No. 13/875,752 filed on May 2, 2013, which is a continuation application of U.S. patent application Ser. No. 13/046,963 filed on Mar. 14, 2011 and issued as U.S. Pat. No. 8,454,120 on Jun. 4, 2013. This application claims priority to Japanese Patent Application No. 2010-058823 filed on Mar. 16, 2010 and Japanese Patent Application No. 2011-005582 filed on Jan. 14, 2011. The entire disclosures of U.S. patent application Ser. Nos. 13/875,752 and 13/046,963, and Japanese Patent Application Nos. 2010-058823 and 2011-005582 are hereby incorporated herein by reference.

BACKGROUND

1. Technical Field

The present invention relates to a liquid ejection device.

2. Related Art

An inkjet printer is a conventionally known liquid ejection device configured to eject a liquid onto a medium. In order to maintain or recover a good ejection characteristic, a maintenance process is executed periodically with respect to a liquid ejecting head of this type of liquid ejection device. More specifically, the maintenance process includes a suction process in which a cap member is positioned so as to cap the liquid ejecting head, an internal space of the cap member is pulled to a vacuum with a vacuum pump, and foam and liquid having an increased viscosity is sucked from the nozzles and discarded and a cleaning process in which a nozzle face of the liquid ejecting head is wiped with a wiping member to remove higher viscosity liquid that has adhered to the nozzle face.

After the suction process, a portion of the liquid sometimes remains on an internal wall surface of the cap member or inside a flow passage leading from the cap member to a waste liquid tank. Over time, the viscosity of the residual liquid increases and the liquid hardens in place, possibly having an adverse effect on the suction process. Consequently, the cap member itself periodically requires a maintenance process. For example, in a liquid ejection device presented in Japanese Laid-Open Patent Publication No. 2007-185795, the cap member is removed from the nozzle face of the liquid ejecting head and the cap member is cleaned with a cleaning liquid ejected from a cleaning liquid nozzle.

SUMMARY

A liquid ejection device according to one aspect of the invention comprises a liquid ejection head, a cleaning member, and a waste liquid tank. The liquid ejection head has a nozzle face on which a nozzle is formed. The cleaning member has a concave space therein and is configured to be attached to the nozzle face such that the concave space is arranged between the cleaning member and the nozzle face. The waste liquid tank is configured to collect cleaning liquid discharged from the cleaning member. The cleaning member further includes a first channel configured to supply the cleaning liquid toward the nozzle face and a second channel configured to discharge the cleaning liquid from the concave space.

According to the aspect of the liquid ejection device, the first channel and the second channel are arranged inside of the cleaning member.

According to the aspect of the liquid ejection device, the liquid ejection device further comprises a cleaning liquid supply port disposed on an end of the first channel and opened toward the nozzle face. The cleaning liquid supply port is configured to eject the cleaning liquid toward the nozzle face from the first channel.

According to the aspect of the liquid ejection device, the liquid ejection device further comprises a cleaning liquid discharge port disposed on an end of the second channel and opened to the concave space. The cleaning liquid discharge port is configured to discharge the cleaning liquid from the concave space to the second channel.

According to the aspect of the liquid ejection device, the liquid ejection device further comprises a discharge valve disposed between the second channel and the waste liquid tank, and the discharge valve is configured to control a discharge flow of the cleaning liquid toward the waste liquid tank.

According to the aspect of the liquid ejection device, the liquid ejection device further comprises a tubular cleaning liquid discharge unit connecting the waste liquid tank and the second channel.

According to the aspect of the liquid ejection device, the discharge valve is arranged in the tubular cleaning liquid discharge unit.

According to the aspect of the liquid ejection device, the liquid ejection device further comprises a supply valve configured to control a supply flow of the cleaning liquid toward the nozzle face.

According to the aspect of the liquid ejection device, the liquid ejection device further comprises a tubular cleaning liquid supply unit connecting the first channel. According to the aspect of the liquid ejection device, the supply valve is arranged in the tubular cleaning liquid supply unit.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
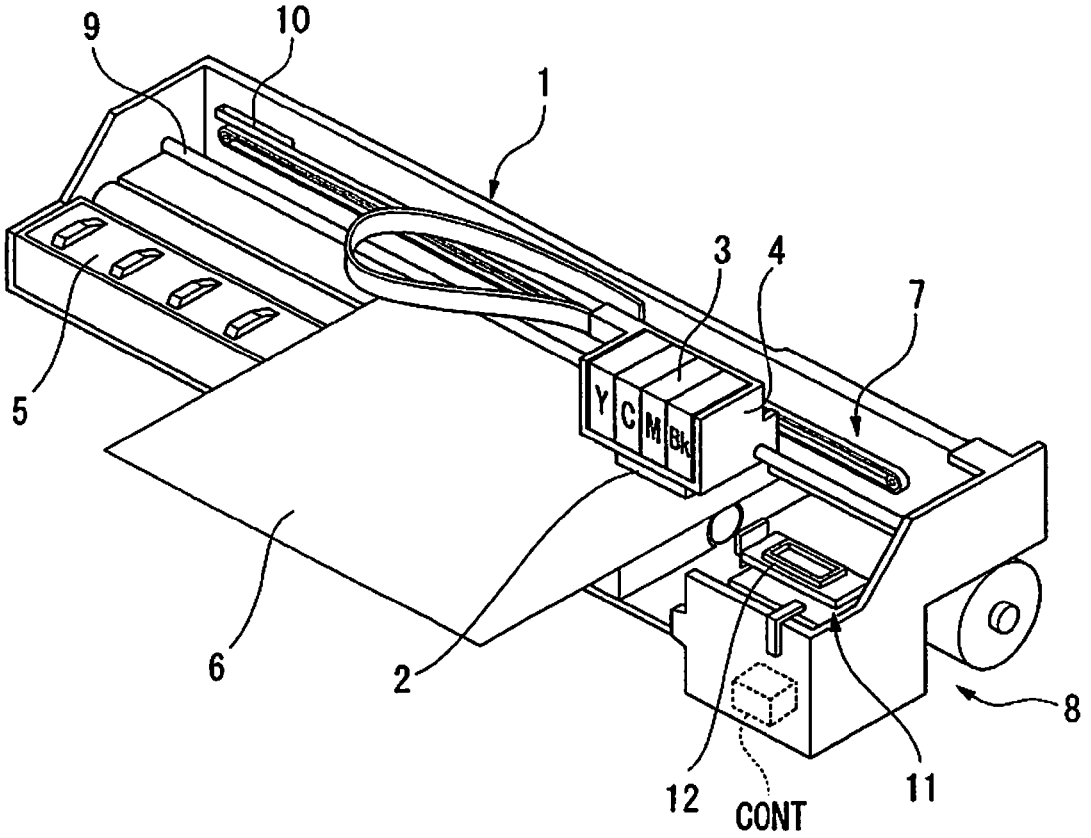
FIG. 1 is a perspective view of an inkjet printer exemplifying a liquid ejection device.

Liquid ejection devices according to embodiments of the present invention will now be explained with reference to the drawings. In the drawings used for the explanations that follow, the relative sizes of the various parts are adjusted as necessary in order to present the parts in a manner that will enable a reader to recognize the parts. In this embodiment, an inkjet printer (hereinafter called merely "printer") is presented as an example of a liquid ejection device according to the present invention.

First Embodiment

FIG. 1 is a perspective view showing constituent features of a printer 1 according to a first embodiment of the present invention.

As shown in the same figure, the printer 1 includes a carriage 4 on which a recording head 2 exemplifying a type of liquid ejecting head is installed and an ink cartridge 3 is detachably mounted, a platen 5 arranged below the recording head 2 and serving to carry a recording paper 6, a carriage moving mechanism 7 configured to move the carriage 4 in a widthwise direction of the recording paper 6, and a paper feeding mechanism 8 configured to transport the recording paper 6 in a paper feed direction. Additionally, the printer 1 has a control device CONT configured to control the operations of the entire printer 1. The aforementioned widthwise direction of the paper is a main scanning direction (a head scanning direction). The aforementioned paper feed direction is a subordinate scanning direction (a direction perpendicular to the main scanning direction).

The ink cartridge 3 is not limited to being mounted to the carriage 4 as in this embodiment. For example, it is acceptable to use an ink cartridge configured to be mounted to a case of the printer 1 and to supply ink to the recording head 2 through an ink supply tube. In this embodiment, the ink cartridge 3 holds water base inks having the colors yellow (Y), magenta (M), cyan (C), and black (Bk).

A guide rod 9 serves as a support member spanning in the main scanning direction. The carriage 4 is installed such that it is supported by the guide rod 9. The carriage 4 is configured to be moved along the guide rod 9 in the main scanning direction by the carriage moving mechanism 7. A linear encoder 10 serves to detect a position of the carriage 4 along the main scanning direction. The linear encoder 10 sends a signal indicating the detected position information to the control device CONT. Based on the position information from the linear encoder 10, the control device CONT recognizes a scanning position of the recording head 2 and controls recording operations (discharge operations) of the recording head 2.

Figure 2:
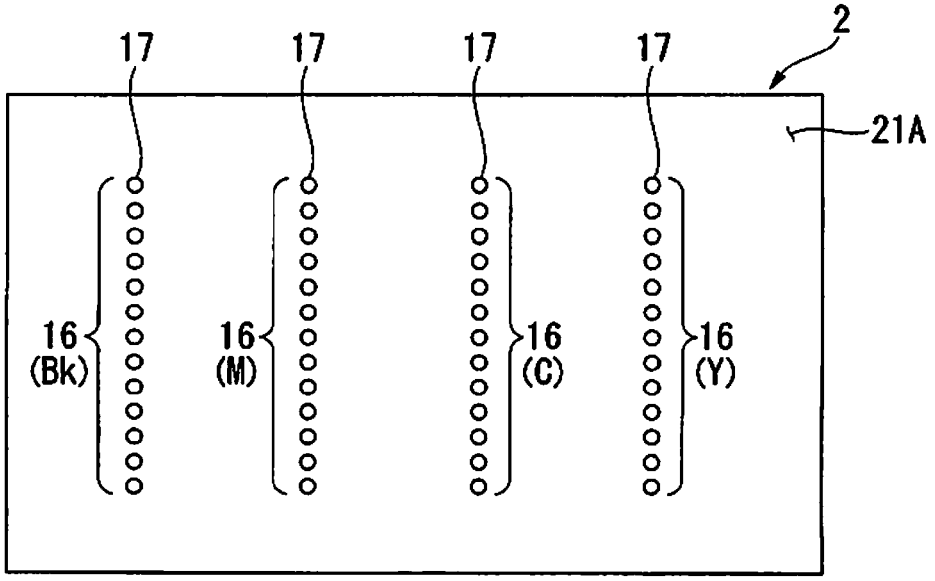
FIG. 2 shows a nozzle array provided in a liquid ejecting head.

FIG. 2 shows an array of nozzles 17 provided on the recording head 2 in accordance with this embodiment of the present invention.

As shown in the same figure, the recording head 2 has a nozzle face 21A in which the nozzles 17 are provided. It is the nozzles 17 from which the inks, which exemplify a liquid, are ejected. Each of the nozzles 17 formed in the nozzle face 21A comprises a nozzle line 16. Each of the nozzle lines 16 can discharge, for example, a different color of ink. In this embodiment, there are four nozzle lines (16 (Bk), 16 (M), 16 (C), and 16 (Y)), each corresponding to one color of ink. One nozzle line 16 comprises, for example, 180 nozzles 17.

Figure 3:
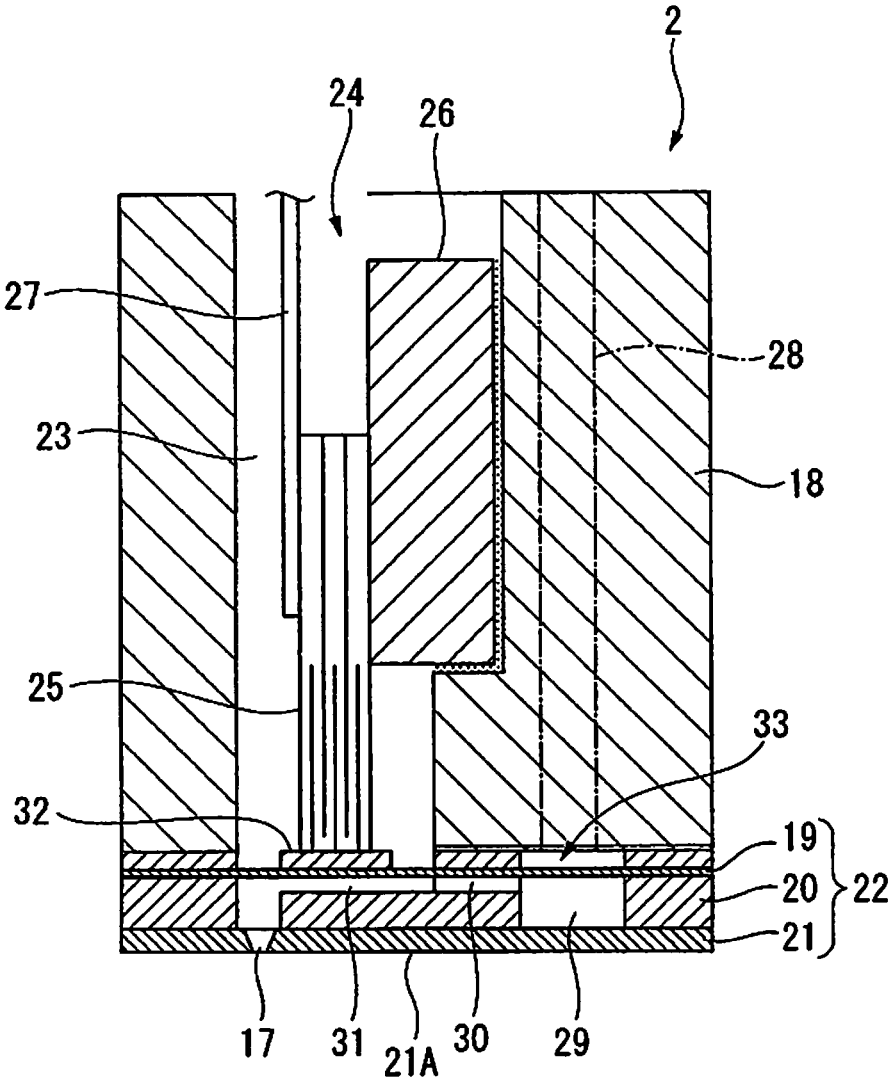
FIG. 3 is a partial cross sectional view showing internal constituent features of the liquid ejecting head.

FIG. 3 is a partial cross sectional view showing internal constituent features of a recording head 2 according to an embodiment of the present invention.

As shown in the same figure, the recording head 2 comprises a head body 18 and a flow passage unit 22 connected to the head body 18. The flow passage unit 22 comprises a vibration plate 19, a flow passage substrate 20, and a nozzle substrate 21 arranged to form a common ink chamber 29, an ink supply port 30, and a pressure chamber 31. The flow passage unit 22 further comprises an island section 32 functioning as a diaphragm and a compliance section 33 serving to absorb pressure fluctuations inside the common ink chamber 29. The head body 18 is configured to have a storage space 23 serving to house a fastening member 26 and a drive unit 24 and an internal flow passage 28 serving to guiding ink to the flow passage 22.

The recording head 2 is equipped with a piezoelectric element 25 that elongates and contracts when a drive signal is fed to the drive unit 24 through a cable 27. As a result, the vibration plate 19 deforms (moves) back and forth toward and away from a cavity. Thus, a volume of the pressure chamber 31 varies and a pressure of the ink inside the pressure chamber 31 fluctuates. The pressure fluctuations cause the ink to be ejected from the nozzles 17.

Returning to FIG. 1, a home position serving as an origin from which the recording head 2 executes a scanning movement is established in a region outside the platen 5 within a movement range of the recording head 12. A capping mechanism 11 is arranged at the home position and configured to execute a maintenance process (suction process and cleaning process) to maintain or recover a good ejection characteristic of the recording head 2.

Figure 4:
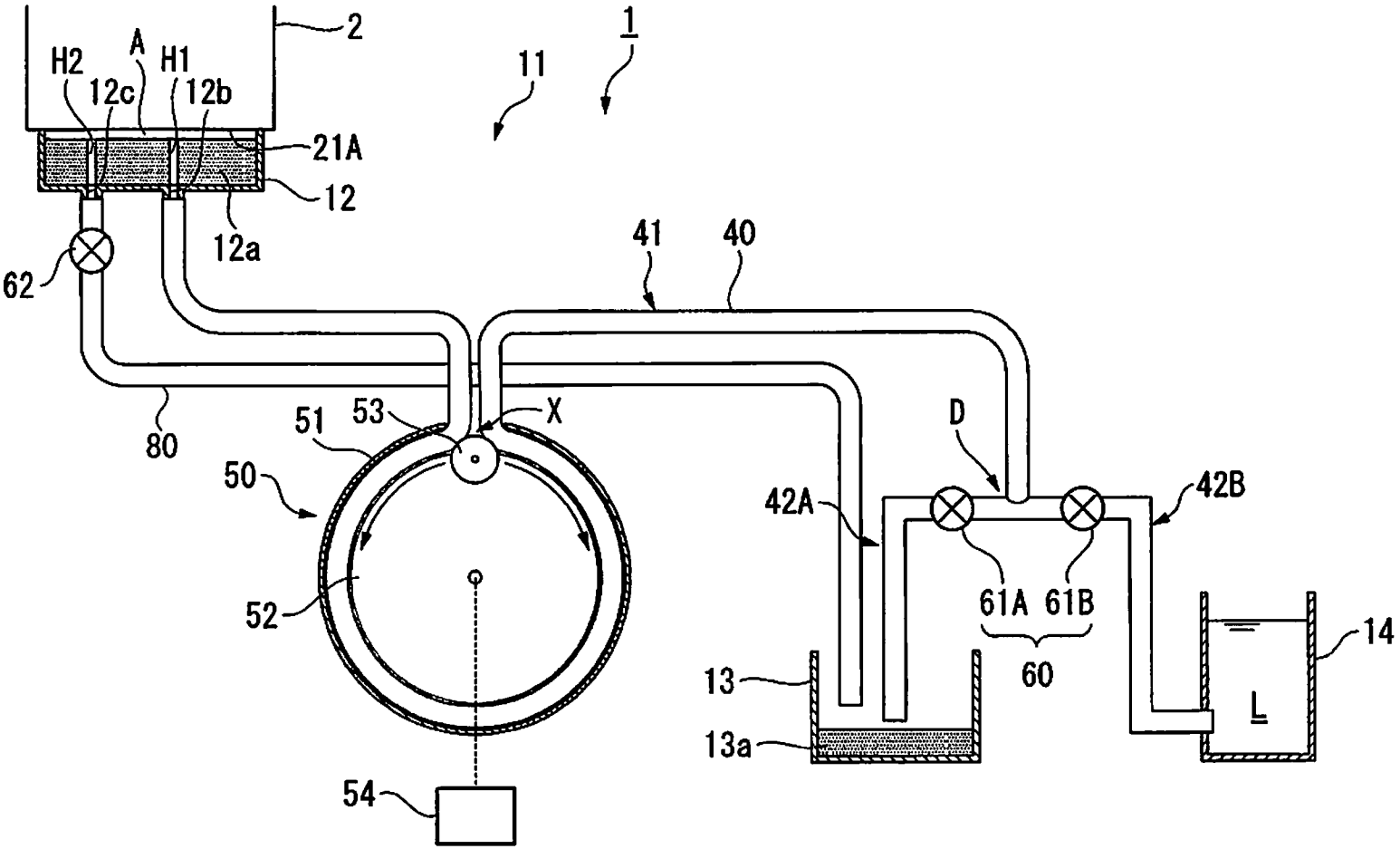
FIG. 4 shows a first embodiment of a capping mechanism installed in a liquid ejection device.

Distinctive characteristics of the capping mechanism 11 of this embodiment will now be explained with reference to FIG. 4. FIG. 4 is a schematic view of a capping mechanism 11 in accordance with an embodiment of the present invention.

The capping mechanism 11 comprises a cap member 12, a waste liquid tank 13, a cleaning liquid tank 14, a branched flow passage 40, a tube pump (suction device) 50, an opening/closing device 60, and an atmospheric venting valve 62.

The cap member 12 is has a bottomed cylinder-like form that is generally cup-like and open on a side facing the nozzle face 2. A rim portion on the open side of the cap member 12 is made of rubber or another elastic material and comprised to be pressed against the recording head 2 so as to enclose the nozzles formed in the nozzle face 21A and form a sealed space A in a region in front of the nozzles.

A cleaning liquid ejection port 12*b* and an atmospheric venting port 12*c* are formed in a bottom surface of the cap member 12 that faces toward the nozzle face 21A. An absorption material 12*a* configured to absorb and hold a liquid is provided inside the cap member 12. The absorption material 12*a* has an opening H1 that is arranged directly above the cleaning liquid ejection port 12*b* and exposes the cleaning liquid ejection port 12*b* and an opening H2 that is arranged directly above the atmospheric venting port 12*c* and exposes the atmospheric venting port 12*c*. The cap member 12 is configured such that it can be moved up and down in a vertical direction by an elevator device (not shown). The elevator device can be, for example, a known elevating means comprising a mechanism combining a motor and a drive screw, a cam mechanism, or a rack and pinion mechanism.

The waste liquid tank 13 serves to store liquid that has been sucked out of the cap member 12 and discarded, and an absorption material 13*a* configured to absorb and hold the waste liquid is provided inside the waste liquid tank 13.

The cleaning liquid tank 14 stores a volatile cleaning liquid L that is used in the cleaning process. The cleaning liquid tank 14 is configured to store a cleaning liquid L having the same composition as a solvent of an ink ejected from the recording head 2. In this embodiment, since the ink is a water based ink, the cleaning liquid tank 14 is configured to store a cleaning liquid L comprising purified water containing an added preservative. The cleaning liquid L is not limited to water; any liquid that can be used as a solvent for an ink can be used as a cleaning liquid.

The branched flow passage 40 is made of a pliable tube member. One end of the branched flow passage 40 communicates with the cleaning liquid ejection port 12*b* of the cap member 12 and the other end branches in two at a prescribed position (hereinafter called a "branch position D") downstream from said one end. One side of the other end is arranged to communicate with the waste liquid tank 13 and the other side of the other end is arranged to communicate with the cleaning liquid tank 14. In the following explanation, the portion of the branched flow passage 40 spanning from the cleaning liquid ejection port 12*b* of the cap member 12 to the branch position D is called a "common flow passage 41," the portion at the other end spanning from the branch position D to the waste liquid tank 13 is called a "first branch flow passage 42A," and the portion at the other end spanning from the branch position D to the cleaning liquid tank 14 is called a "second branch flow passage 42B."

The tube pump 50 is provided in the common flow passage 41 upstream of the branch position D. The tube pump 50 comprises a pump case 51 that is generally cylindrical and configured to curve a portion of the common flow passage 41 into a circular shape, a pump wheel 52 that is provided inside the pump case 51 and configured to rotate about an axial center of the pump case 51, a roller member 53 that is rotatably supported on an outer rim of the pump wheel 52, and a motor 54 configured to rotate the pump wheel 52 in a forward direction (counterclockwise in FIG. 4) or a reverse direction (clockwise in FIG. 4) in accordance with instructions from the control device CONT.

The tube pump 50 executes a first suction operation by rotating the pump wheel 52 in the forward direction such that the roller member 53 is made to revolve from one end of the circular portion of the common flow passage 41 to the other end while pressing against a radially inward side of the common flow passage 41 so as to cause deformation of the common flow passage 41. In this way, suction is produced inside the branched flow passage 40 in a direction oriented from the one end toward the other end.

Meanwhile, the tube pump 50 executes a second suction operation by rotating the pump wheel 52 in the reverse direction such that the roller member 53 is made to revolve from said other end of the circular portion of the common flow passage 41 to said one end while pressing against a radially inward side of the common flow passage 41 so as to cause deformation of the common flow passage 41. In this way, suction is produced inside the branched flow passage 40 in a direction oriented from the other end toward the one end.

The tube pump 50 has a leak point X where the amount of deformation of the common flow passage 41 caused by the pressure of the roller member 53 is as small as when neither the first suction operation nor the second suction operation is executed. When the tube pump 50 is in a released state, the roller member 53 is positioned at the leak point X.

The opening/closing device 60 has an on-off valve 61A configured to switch the first branch passage 42A between a closed state and an open state and an on-off valve 61B configured to switch the second branch passage 42B between a closed state and an open state. The atmospheric venting valve 62 is configured to allow the ambient atmosphere to communicate with or prohibit the ambient atmosphere from communicating with a space A defined by the nozzle face 21A and the cap member 12 through the atmospheric venting port 12*c* provided in a bottom surface of the cap member 12. In response to instructions from the control device CONT, the atmospheric venting valve 62 switches between a state in which the space A is held in an airtight condition (sealed state) and a state in which the air tight condition is released (vented state). A cleaning liquid discharge tube 80 is connected to the atmospheric venting valve 62 on the opposite side of the atmospheric venting valve 62 as the atmospheric venting port 12*c* and extends to the waste tank 13.

In this embodiment, when the tube pump 50 executes a first suction operation, the opening/closing device 60 drives the on-off valve 61A such that the first branch flow passage 42A is put into open state and drives the on-off valve 61B such that the second branch passage 42B is put into a closed state. At the same time, the atmospheric venting valve 62 closes off the space A and maintains an airtight condition.

Conversely, when the tube pump 50 executes a second suction operation, the opening/closing device 60 drives the on-off valve 61A such that the first branch flow passage 42A is put into a closed state and drives the on-off valve 61B such that the second branch passage 42B is put into an opened state. At the same time, the atmospheric venting valve 62 opens the space A and breaks the airtight state.

Figure 5:
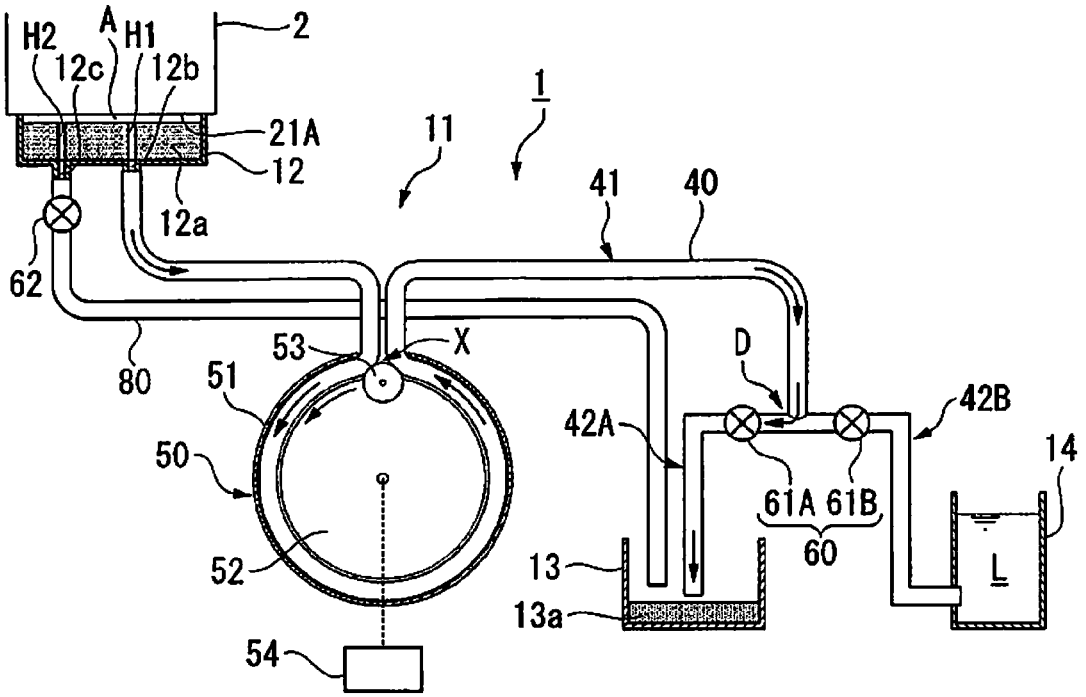
FIG. 5 illustrates a liquid flow pattern occurring when liquid is sucked from a nozzle.
Figure 6:
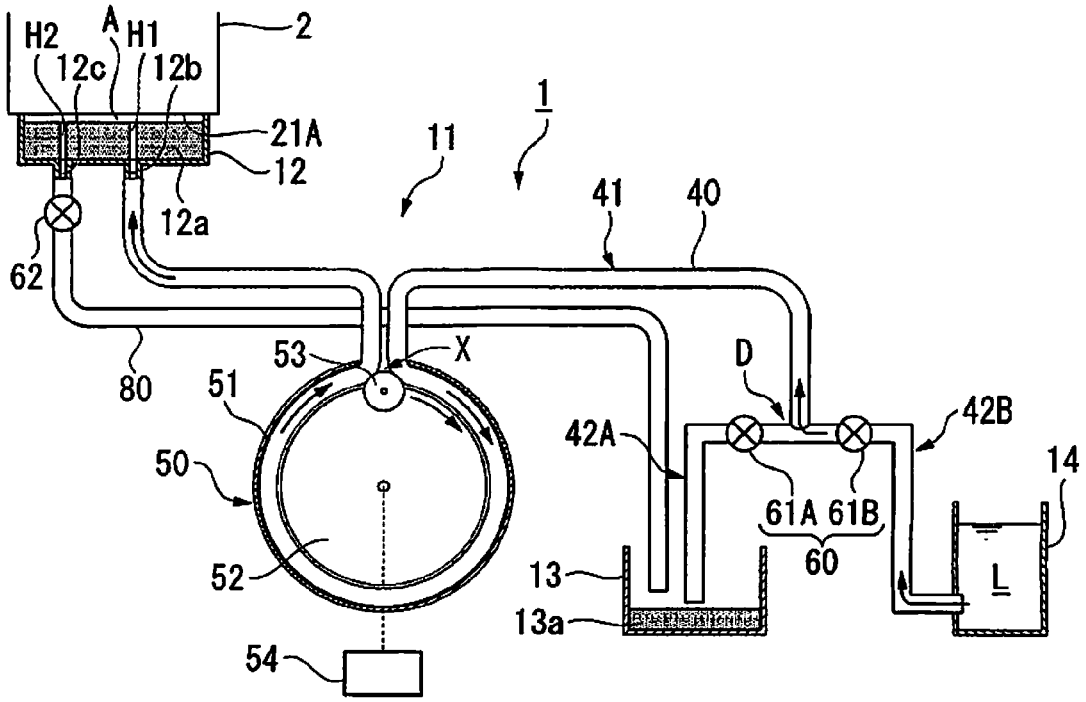
FIG. 6 illustrates a liquid flow pattern occurring when a cleaning liquid is ejected at a nozzle face.

A suction process and a cleaning process of the printer 1 will now be explained with reference to FIG. 5 and FIG. 6 FIG. 5 shows a liquid flow pattern occurring when a suction process is executed in accordance with an embodiment of the present invention. FIG. 6 shows a liquid flow pattern occurring when a cleaning process is executed in accordance with an embodiment of the present invention.

In the suction process shown in FIG. 5, the control device CONT first positions the cap member 12 such that it touches against the recording head 2 and surrounds the nozzle face 21A, thereby forming a sealed space A. The control section CONT then drives the atmospheric venting valve 62 such that the space A is put into a closed off state. Next, the control device CONT sends a control signal related to a first suction operation to the opening/closing device 60, thereby driving the on-off valve 61A such that the first branch flow passage 42A is opened and driving the on-off valve 61B such that the second branch passage 42B is closed. The control device CONT then sends a control signal related to the first suction operation to the tube pump 50 and drives the motor 54 such that the pump wheel 52 rotates in the forward direction.

When the pump wheel 52 is driven in the forward rotation direction, the roller member 53 revolves from one end of the circular portion of the common flow passage 41 to the other end while pressing against a radially inward side of the common flow passage 41 so as to cause deformation of the common flow passage 41. In this way, suction is produced inside the branched flow passage 40 in a direction oriented from the one end toward the other end. Since the common flow passage 41 communicates with the cap member 12, a negative pressure state is created in the sealed space A when this suction operation creates a negative pressure inside the common flow passage 41. When the sealed space A is pulled to a negative pressure, ink having an increased viscosity, foam, adhered particles, and the like are forcefully sucked from the nozzles 17 formed in the nozzle face 21A.

The ink and other materials sucked from the nozzles 17 pass through the common flow passage 41 and arrive at the branch position D. At the branch position D, the ink and other materials close through the open first branch flow passage 42A and exit to the waste tank 13. The ink and other materials do not flow toward the cleaning liquid tank 14 because the second branch flow passage 42B is closed by the on-off valve 61B.

During the cleaning process shown in FIG. 6, the control device CONT first positions the cap member 12 such that it touches against the recording head 2 and surrounds the nozzle face 21A, thereby forming a sealed space A between the nozzle face 21A of the recording head 2 and the cap member 12. The control section CONT then drives the atmospheric venting valve 62 such that the space A is in a vented state. Next, the control section CONT sends a control signal related to a second suction operation to the opening/closing device 60, thereby driving the on-off valve 61A such that the first branch flow passage 42A is closed and driving the on-off valve 61B such that the second branch passage 42B is opened. The control device CONT then sends a control signal related to the second suction operation to the tube pump 50 and drives the motor 54 such that the pump wheel 52 rotates in the reverse direction.

When the pump wheel 52 is driven in the reverse rotation direction, the roller member 53 revolves from said other end of the circular portion of the common flow passage 41 to said one end while pressing against a radially inward side of the common flow passage 41 so as to cause deformation of the common flow passage 41. In this way, suction is produced inside the branched flow passage 40 in a direction oriented from the other end toward the one end. Since the first branch flow passage 42A is closed by the on-off valve 61A at the branch position D, only the second branch flow passage 42B is pulled to a negative pressure. When the second branch flow passage 42B is pulled to a negative pressure, cleaning liquid L is drawn from the cleaning liquid tank 14 into the second branch flow passage 42B and supplied to the cap member 12 through the common flow passage 41. The cleaning liquid L ejects from the cleaning liquid ejection port 12*b* toward the nozzle face 21A of the recording head 2. Since the space A is vented to the atmosphere, the pressure inside the space A does not increase due to the ejection of the cleaning liquid L from the cleaning liquid ejection port 12*b*. Consequently, a gap through which the cleaning liquid and other materials might escape to the outside does not form between the cap member 12 and the nozzle face 21A.

Since the opening H1 is provided in the absorption material 12*a* such that it exposes the cleaning liquid ejection port 12*b*, the cleaning liquid L ejected from the cleaning liquid ejection port 12*b* reaches the nozzle face 21A of the recording head 2 without being blocked by the absorption material 12*a*. A portion of the cleaning liquid ejected at the nozzle face 21A cleans an internal wall surface of the cap member 12 and passes through the cleaning liquid discharge tube 80 connected to the atmospheric venting valve 62 and exists into the waste liquid tank 13. The bottom surface of the cap member 12—where residual ink collects most easily—is cleaned by the cleaning liquid that flows across the bottom surface.

Since the common flow passage 41 is used for both the suction process and the cleaning process, ink that adheres to an inside of the common flow passage 41 during a suction process is flushed out by the supply of cleaning liquid L during a cleaning process. In this embodiment, the ink is a water based ink and the cleaning liquid L is water having the same composition as the solvent of the ink. Thus, the ink can be cleaned without pigments becoming coagulated and the inside of the common flow passage 41 can be prevented from becoming clogged with hardened ink.

After the process of cleaning the nozzle face 21A and the cap member 12 with the cleaning liquid L is finished, the control device CONT stops the second suction operation of the tube pump 50.

With this printer 1, after the cleaning liquid L ejected from the cleaning liquid ejection port 12*b* cleans the nozzle face 21A, it cleans a portion of the space A between the nozzle face 21A and the cap member 12 (a bottom surface and an internal wall surface of the cap member 12 facing the space A) and a portion of the flow passage leading from the cap member 12 to the waste liquid tank 13 before being discharged to the waste liquid tank 13. Consequently, maintenance of the recording head 2 and the cap member 12 can be executed simultaneously and the efficiency of the maintenance process can be improved. Since the cleaning liquid ejection port 12*b* is arranged inside the cap member 12, the cleaning liquid L is not likely to scatter to a periphery of the cap member 12. Since the cleaning liquid L ejected from the cleaning liquid ejection port 12*b* passes through the cleaning liquid discharge tube 80 connected to the atmospheric venting valve 62 and is discharged into the waste liquid tank 13, it is even less likely that the cleaning liquid L will scatter to a periphery of the cap member 12. Thus, an after treatment to clean scattered cleaning liquid from a periphery of the cap member 12 can be abbreviated or eliminated entirely.

With this printer 1, a discharge process in which liquid is discharged from the cap member 12 to the waste liquid tank 13 by means of a first suction operation and a supply process in which the cleaning liquid L is supplied from the cleaning liquid tank 14 to the cap member 12 by means of a second suction operation can be accomplished using a common tube pump 50. The discharge process of discharging liquid to the waste liquid tank 13 and the supply process of supplying cleaning liquid L to the cap member 12 both take place through the cleaning liquid ejection port 12*b*. Consequently, it is not necessary to provide a separate liquid discharge port and a separate cleaning liquid ejection port, a fact which contributes to simplifying the cap member 12. Also, since a common port serves as both a liquid discharge port and a cleaning liquid ejection port, the cleaning liquid ejection port 12*b* can be enlarged or cleaning liquid ejection ports can be provided in a plurality of locations to increase the cleaning efficiency. Additionally, with the printer 1, since the tube pump 50 has a leak point where the amount of deformation of the branched flow passage caused by the pressure of the roller member 53 is as small as when neither the first suction operation nor the second suction operation is executed, venting the cap member 12 to the atmosphere can also be accomplished through the cleaning liquid ejection port 12*b*. Consequently, it is not necessary to provide a separate air supply port and a separate cleaning liquid ejection port, a fact which further contributes to simplifying the cap member 12.

Second Embodiment

Figure 7:
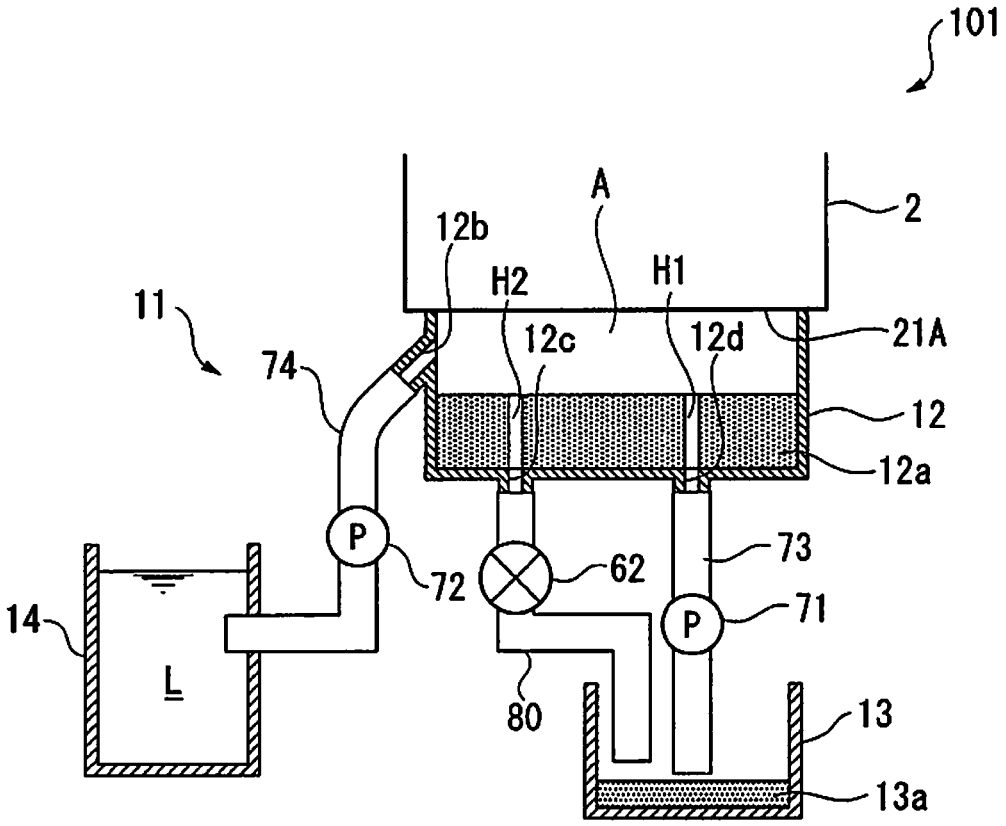
FIG. 7 shows a second embodiment of a capping mechanism installed in a liquid ejection device.

FIG. 7 is a perspective view showing constituent features of a printer 101 according to a second embodiment of the present invention.

The printer 101 of the second embodiment differs from the printer 1 of the first embodiment in that a flow passage leading from the cap member 12 to the waste tank 103 and a flow passage leading from the cleaning liquid tank 14 to the cap member 12 are provided separately. Parts of the second embodiment that are the same as the parts of the printer 1 of the first embodiment are indicated with the same reference numerals and explanations thereof are omitted for the sake of brevity.

The capping mechanism 11 comprises a cap member 12, a waste liquid tank 13, a cleaning liquid tank 14, a waste liquid flow passage 73, a waste liquid pump (suction device) 71, a cleaning liquid flow passage 74, and a cleaning liquid pump 72.

The cap member 12 is has a bottomed cylinder-like form that is generally cup-like and open on a side facing the nozzle face 2. A rim portion on the open side of the cap member 12 is made of rubber or another elastic material and comprised to be pressed against the recording head 2 so as to enclose the nozzles formed in the nozzle face 21A and form a sealed space A in a region in front of the nozzles.

A waste liquid discharge port 12*d* and an atmospheric venting port 12*c* are formed in a bottom surface of the cap member 12 that faces toward the nozzle face 21A. A cleaning liquid ejection port 12*b* is formed on a side face of the cap member 12. An absorption material 12*a* configured to absorb and hold a liquid is provided inside the cap member 12. The absorption member 12*a* has an opening H1 that is arranged directly above the waste liquid discharge port 12*d* and exposes the waste liquid discharge port 12*c* and an opening H2 that is arranged directly above the atmospheric venting port 12*c* and exposes the atmospheric venting port 12*c*. The cleaning liquid ejection port 12*b* is formed above the absorption material 12*a* and, thus, the cleaning liquid ejection port 12*b* is not blocked by the absorption material 12*a*. A portion the cleaning liquid flow passage 74 in a vicinity of the cleaning liquid ejection port 12*b* is arranged to be diagonal with respect to a side wall of the cap member 12 such that the cleaning liquid L is ejected diagonally with respect to the nozzle face 21A.

The waste liquid flow passage 73 is made of a pliable tube having one end in communication with the waste liquid discharge port 12*d* of the cap member 12 and another end in communication with the waste liquid tank 13. A waste liquid pump 71 is provided in an intermediate position along the waste liquid flow passage 73. The waste liquid pump 71 is configured to execute a first suction operation in which a suction is generated inside of the waste liquid flow passage 73 in a direction oriented from the one end toward the other end of the waste liquid flow passage 73.

The waste liquid flow passage 74 is made of a pliable tube having one end in communication with the cleaning liquid ejection port 12*b* of the cap member 12 and another end in communication with the cleaning liquid tank 14. A cleaning liquid pump 72 is provided in an intermediate position along the cleaning liquid flow passage 74. The cleaning liquid pump 72 is configured to execute a second suction operation in which a suction is generated inside of the cleaning liquid flow passage 74 in a direction oriented from the other end toward the one end of the waste liquid flow passage 74.

The waste liquid pump 71 and the cleaning liquid pump 72 can be tube pumps like that presented in the first embodiment, but it is also acceptable to use another type of pump.

The atmospheric venting valve 62 is configured to allow the ambient atmosphere to communicate with or prohibit the ambient atmosphere from communicating with a space A defined by the nozzle face 21A and the cap member 12 through the atmospheric venting port 12*c* provided in a bottom surface of the cap member 12. In response to instructions from the control device CONT, the atmospheric venting valve 62 switches between a state in which the space A is held in an airtight condition (closed state) and a state in which the air tight condition is released (vented state).

In the suction process, the control device CONT first positions the cap member 12 such that it touches against the recording head 2 and surrounds the nozzle face 21A, thereby forming a sealed space A. The control section CONT then drives the atmospheric venting valve 62 such that the space A is put into a closed off state. Next, the control device CONT sends a control signal related to a first suction operation to the waste liquid pump 71 to pull the sealed space A to a negative pressure state. When the sealed space A is pulled to a negative pressure, ink having an increased viscosity, foam, adhered particles, and the like are forcefully sucked from the nozzles 17 formed in the nozzle face 21A.

During the cleaning process, the control device CONT first positions the cap member 12 such that it touches against the recording head 2 and surrounds the nozzle face 21A, thereby forming a sealed space A between the nozzle face 21A of the recording head 2 and the cap member 12. The control section CONT then drives the atmospheric venting valve 62 such that the space A is in a vented state. Next, the control section CONT sends a control signal related to a second suction operation to the cleaning liquid pump 72 such that cleaning liquid L is drawn from the cleaning liquid tank 14 and ejected from the cleaning liquid ejection port 12*b* toward the nozzle face 21A of the recording head 2. Since the space A is vented to the atmosphere, the pressure inside the space A does not increase due to the ejection of the cleaning liquid L from the cleaning liquid ejection port 12*b*. Consequently, a gap through which the cleaning liquid and other materials might escape to the outside does not form between the cap member 12 and the nozzle face 21A.

The cleaning liquid L ejected from the cleaning liquid ejection port 12*b* cleans the entire nozzle face 21A. After cleaning an internal wall surface of the cap member 12, a portion of the cleaning liquid L passes along the bottom surface of the cap member 12 and is discharged to the waste liquid tank 13. The bottom surface of the cap member 12—where residual ink collects most easily—is cleaned by the cleaning liquid that flows across the bottom surface.

After the process of cleaning the nozzle face 21A and the cap member 12 with the cleaning liquid L is finished, the control device CONT stops the second suction operation of the cleaning liquid pump 72.

With this printer 101, too, after the cleaning liquid L ejected from the cleaning liquid ejection port 12*b* cleans the nozzle face 21A, it cleans a portion of the space A between the nozzle face 21A and the cap member 12 (a bottom surface and an internal wall surface of the cap member 12 facing the space A) and a portion of the flow passage leading from the cap member 12 to the waste liquid tank 13 before being discharged to the waste liquid tank 13. Consequently, maintenance of the recording head 2 and the cap member 12 can be executed simultaneously and the efficiency of the maintenance process can be improved. Since the cleaning liquid ejection port 12*b* is arranged inside the cap member 12, the cleaning liquid L is not likely to scatter to a periphery of the cap member 12. Thus, an after treatment to clean scattered cleaning liquid from a periphery of the cap member 12 can be abbreviated or eliminated entirely.

Although preferred embodiments of the present invention are explained herein with reference to the drawings, the present invention is not limited to these embodiments. The shapes and combinations of the constituent parts described in the embodiments are merely examples, and various modifications can be made based on design requirements without departing from the scope of the invention as defined by the claims.

For example, although in the embodiments the liquid (liquid substance) ejected by the liquid ejection device is ink, the present invention can also be applied to a liquid ejection device configured to eject or spray a liquid other than ink. Liquids that can be ejected by the liquid ejection device include liquids, liquid substances containing dispersed or dissolved particles of a functional material, and gel-like liquid substances.

Other examples of liquid ejection devices include liquid ejection devices for ejecting a bioorganic compound used for manufacturing bio-chips and liquid ejection devices used as a precision pipette for ejecting a liquid that will serve as a test sample.

Other examples include liquid ejection devices configured to eject a lubricating oil onto precision mechanical parts of watches, cameras, and the like in a precision fashion, liquid ejection devices configured to eject an ultraviolet curing resin or other transparent resin onto a substrate in order to manufacture tiny spherical lenses (optical lenses) used in optical communication devices, liquid ejection devices for ejecting an acid or base etching liquid in order to etch a substrate, and liquid substance ejecting apparatuses configured to eject a gel. The present invention can be applied to any of these types of liquid ejection devices.

A liquid ejection device according to one embodiment includes a liquid ejection head, a cap member and a cleaning liquid. The liquid ejection head has a nozzle face in which a nozzle is formed. The cap member is attached to the nozzle face such that a space exists in a region facing the nozzle. The cleaning liquid ejection port is arranged inside the space to eject a cleaning liquid toward the nozzle face.

With these constituent features, after the cleaning liquid ejected from the cleaning liquid ejection port cleans the nozzle face, it cleans a portion of the space between the nozzle face and the cap member (a bottom surface and an internal wall surface of the cap member facing the space) and a portion of a flow passage leading from the cap member to a waste liquid tank before being discharged to the waste liquid tank. Consequently, maintenance of the liquid ejecting head and the cap member can be executed simultaneously and the efficiency of the maintenance process can be improved. Since the cleaning liquid ejection port is arranged inside the cap member, the cleaning liquid is not likely to scatter onto a periphery of the cap member. Thus, an after treatment to clean scattered cleaning liquid from a periphery of the cap member can be abbreviated or eliminated entirely.

The apparatus preferably includes: a branched flow passage having one end that communicates with the cleaning liquid ejection port of the cap member and the other end that branches in two at a prescribed position downstream from the one end, one side of the other end being arranged to communicate with a waste liquid tank and another side of the other end being arranged to communicate with a cleaning liquid tank serving to store the cleaning liquid; a suction device that is arranged upstream of the prescribed position and configured to execute a first suction operation in which suction is applied to the inside of the branched flow passage in a direction oriented from the one end toward the other end and a second suction operation in which suction is applied to the inside of the branched flow passage in a direction oriented from the other end toward the one end; and an opening/closing device configured to open a flow passage of the one side of the other end and close a flow passage of the other side of the other end during the first suction operation and to close the flow passage of the one side of the other end and open the flow passage of the other side of the other end during the second suction operation.

With these constituent features, a discharge process in which liquid is discharged from the cap member to the waste liquid tank by means of the first suction operation and a supply process in which the cleaning liquid is supplied from the cleaning liquid tank to the cap member by means of the second suction operation can be accomplished with a common suction device. The discharge process of discharging liquid to the waste liquid tank and the supply process of supplying cleaning liquid to the cap member both take place through the cleaning liquid ejection port. Consequently, it is not necessary to provide a separate liquid discharge port in addition to the cleaning liquid ejection port, a fact which contributes to simplifying the cap member. Also, since a common port serves as both a liquid discharge port and a cleaning liquid ejection port, the cleaning liquid ejection port can be enlarged or cleaning liquid ejection ports can be provided in a plurality of locations to increase the cleaning efficiency.

The suction device is preferably a tube pump configured to execute the first suction operation and the second suction operation by bending a portion of the branched flow passage located upstream of the prescribed position into a circular ring shape, pressing a roller member against a radially inward side of the circular ring-shaped branched flow passage, and rolling the roller member along the branched flow passage in a forward direction or a reverse direction so as to cause deformation of the flow passage.

In this way, a suction device that can execute the first suction operation and the second suction operation can be fabricated easily.

The suction device preferably has a leak point where an amount of deformation of the branched flow passage caused by pressure of the roller member becomes as small as when neither the first suction operation nor the second suction operation is executed.

With such a constituent feature, the branched flow passage can be opened to the ambient atmosphere by arranging the roller member at the leak point. The cap member is opened to the ambient atmosphere through the cleaning liquid ejection port. Consequently, it is not necessary to provide a separate air supply port in addition to the cleaning liquid ejection port, a fact which contributes to simplifying the cap member.

Preferably, the cap member is generally shaped like a bottomed cylinder that is open on a side facing the nozzle face, and the cleaning liquid ejection port is formed in a bottom surface of the cap member that faces the nozzle face.

With these constituent features, the cleaning liquid passes along the bottom surface of the cap member before it is discharged to the waste liquid tank, thereby enabling the bottom surface of the cap member to be cleaned with the cleaning liquid. This is advantageous because the bottom surface of the cap member is where residual liquid collects most easily.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid ejection device comprising:

a liquid ejection head having a nozzle face on which a nozzle is formed;

a cleaning member having a concave space therein, the cleaning member being configured to be attached to the nozzle face such that the concave space is arranged between the cleaning member and the nozzle face; and a waste liquid tank configured to collect cleaning liquid discharged from the cleaning member, the cleaning member further including a first channel configured to supply the cleaning liquid toward the nozzle face and a second channel configured to discharge the cleaning liquid from the concave space.

2. The liquid ejection device according to claim 1, wherein the first channel and the second channel are arranged inside of the cleaning member.

3. The liquid ejection device according to claim 1, further comprising a cleaning liquid supply port disposed on an end of the first channel and opened toward the nozzle face, the cleaning liquid supply port being configured to eject the cleaning liquid toward the nozzle face from the first channel.

4. The liquid ejection device according to claim 1, further comprising a cleaning liquid discharge port disposed on an end of the second channel and opened to the concave space, the cleaning liquid discharge port being configured to discharge the cleaning liquid from the concave space to the second channel.

5. The liquid ejection device according to claim 1, further comprising a discharge valve disposed between the second channel and the waste liquid tank, the discharge valve being configured to control a discharge flow of the cleaning liquid toward the waste liquid tank.

6. The liquid ejection device according to claim 5, further comprising a tubular cleaning liquid discharge unit connecting the waste liquid tank and the second channel.

7. The liquid ejection device according to claim 6, wherein the discharge valve is arranged in the tubular cleaning liquid discharge unit.

8. The liquid ejection device according to claim 1, further comprising a supply valve configured to control a supply flow of the cleaning liquid toward the nozzle face.

9. The liquid ejection device according to claim 8, further comprising a tubular cleaning liquid supply unit connecting the first channel.

10. The liquid ejection device according to claim 9, wherein the supply valve is arranged in the tubular cleaning liquid supply unit.

* * * * *